United States Patent [19]

Sato

[11] 4,176,600

[45] Dec. 4, 1979

[54] TYPE POSITIONING MECHANISM FOR PRINTING DEVICE

[75] Inventor: Yo Sato, Tokyo, Japan

[73] Assignee: Kabushiki Kaisha Sato, Tokyo, Japan

[21] Appl. No.: 867,006

[22] Filed: Jan. 5, 1978

[51] Int. Cl.[2] ..... B41J 1/20

[52] U.S. Cl. ..... 101/111; 400/146

[58] Field of Search ..... 101/111, 110; 400/146

[56] References Cited

U.S. PATENT DOCUMENTS 3,977,321 8/1976 Pabodie ..... 101/111

FOREIGN PATENT DOCUMENTS 2141544 2/1973 Fed. Rep. of Germany ..... 101/111

105325 12/1974 Norway ..... 101/111

*Primary Examiner*—William Pieprz

*Attorney, Agent, or Firm*—Ostrolenk, Faber, Gerb & Soffen

[57] ABSTRACT

A type positioning mechanism for use in a printing device of a hand labeler, or the like, including a plurality of rotatable, coaxial selecting wheels, corresponding rotatable coaxial positioning members juxtaposed to and spaced from the selecting wheels and corresponding endless type bands each formed with a plurality of printing types and arranged to run over a corresponding pair of the selecting wheels and positioning members; the type positioning mechanism includes a guide block which is stationary relative to the selecting wheels and positioning members; the guide block has parallel bores therein; pins are received in the corresponding bores and are slidable back and forth; there are thrust members, each integral with the corresponding pin and having one end formed with a conically or wedge shaped projection that is engageable with a complementary depression in the corresponding positioning member for holding the corresponding type band at a particular printing orientation; biasing means urge the thrust member projections into engagement with the corresponding positioning member depressions.

13 Claims, 9 Drawing Figures

PRIOR ART

TYPE POSITIONING MECHANISM FOR PRINTING DEVICE

BACKGROUND OF THE INVENTION

The present invention relates to a printing device for use either with a preferably portable, label printing and applying machine (hereafter referred to as a "hand labeler") or with a tagging machine, and more particularly relates to a type positioning mechanism for use in the printing device, in which desired printing types can be selectively brought into correct printing positions. Various type positioning mechanisms are shown in application Ser. No. 837,542, filed Sept. 28, 1977.

Especially due to wear of the mechanical parts, conventional type positioning mechanisms have often failed to bring desired printing types into the correct printing positions with the resultant disadvantage that it is impossible to obtain clear and correct printing.

SUMMARY OF THE INVENTION

It is a primary object of the present invention to provide a type positioning mechanism for use in a printing device and which is free from any disadvantages of the prior art.

Another object of the present invention is to provide a type positioning mechanism of the above type, which brings selected printing types into the correct printing positions.

A further object of the present invention is to provide such a type positioning mechanism, in which a positioning operation can be clearly confirmed by the operator through an audible click or a perceivable response that is felt when the positioning parts are actuated.

According to the present invention, a type positioning mechanism for use in a printing device includes a plurality of rotatable selecting wheels which are arranged side by side for coaxial rotation, a corresponding number of positioning members juxtaposed to and spaced from the selecting wheels and arranged side by side for coaxial rotation, and a corresponding number of endless type bands, each carrying a plurality of printing types on its exterior and each running over a corresponding pair of the selecting wheels and positioning members. A desired printing type is brought into the printing position when the corresponding one of the selecting wheels is turned.

The type positioning mechanism further comprises a guide block that is arranged stationary relative to the selecting wheels and positioning members. The guide block is formed with parallel bores in it, the same number as the number of type bands. A corresponding number of pins are received in the bores of the guide block for sliding back and forth therein. There are a corresponding number of thrust members, each being integral with the corresponding one of the pins and each having one end formed with a first formation, preferably a projection, which is made engageable with the corresponding one of the positioning members for holding the corresponding type bands in position. The positioning member has a second formation, preferably a depression, which receives the projection and is, therefore, complementary thereto. Biasing means continuously bias the thrust members into engagement with the positioning members. In an alternate version, it is the positioning member that carries the projection, while the thrust member has the complementary depression for receiving the projection.

BRIEF DESCRIPTION OF THE DRAWINGS

Other objects and features of the present invention will become apparent from the following description taken in conjunction with the accompanying drawings, in which:

FIG. 8(*b*) shows the condition in which the type positioning mechanism of FIG. 8(*a*) fails to perform the correct positioning operation.

DESCRIPTION OF THE PREFERRED EMBODIMENTS

Figure 1:
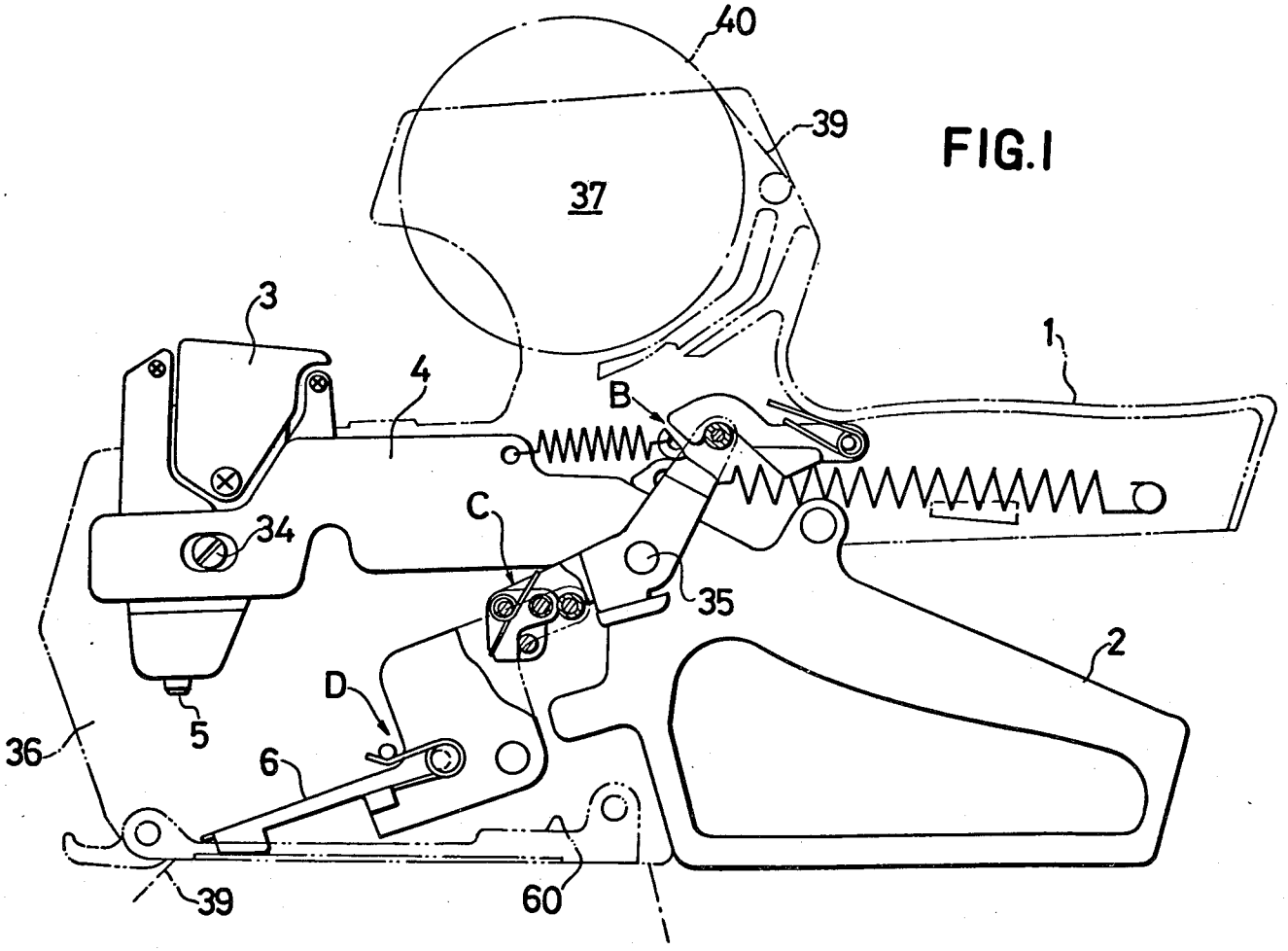
FIG. 1 is a side elevational view showing some features of a hand labeler in which a printing device equipped with a type positioning mechanism according to the present invention is incorporated, and the machine frame on the viewing side of the labeler is removed.

Printing devices for use in a hand labeler, or the like, are now described. Generally, the printing devices are of two types. In one of these, shown in FIG. 1, a printing head 3 is fixed to a yoke 4 that as is moved up and down by the squeezing together and releasing of a grip 1 and a hand lever 2. The yoke is connected with the hand lever to be so moved. Printing types 5 positioned at the lower end of the printing head 3 move downward together with the yoke 4 and are brought into abutting engagement with a label on the platen 6. The platen is fixed to the machine frames 36 and 36'.

In the other type of printing device, the printing head 3 is fixed to machine frames 36 and 36' of the hand labeler, or the like. The platen 6 is elevated in response to the squeezing action of the hand lever 2 and the grip 1 so that the label on the platen is also brought into abutting engagement with the printing types 5 at the lower end of the printing head 3.

Figure 2:
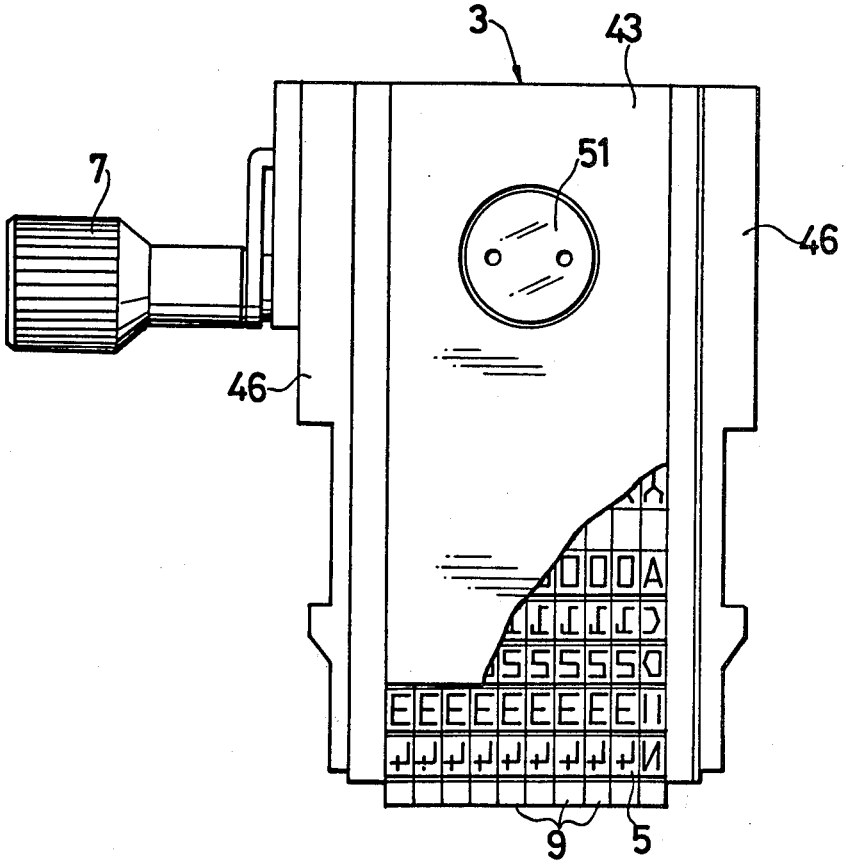
FIG. 2 is a front elevational view showing the printing device of FIG. 1 on an enlarged scale.
Figure 3:
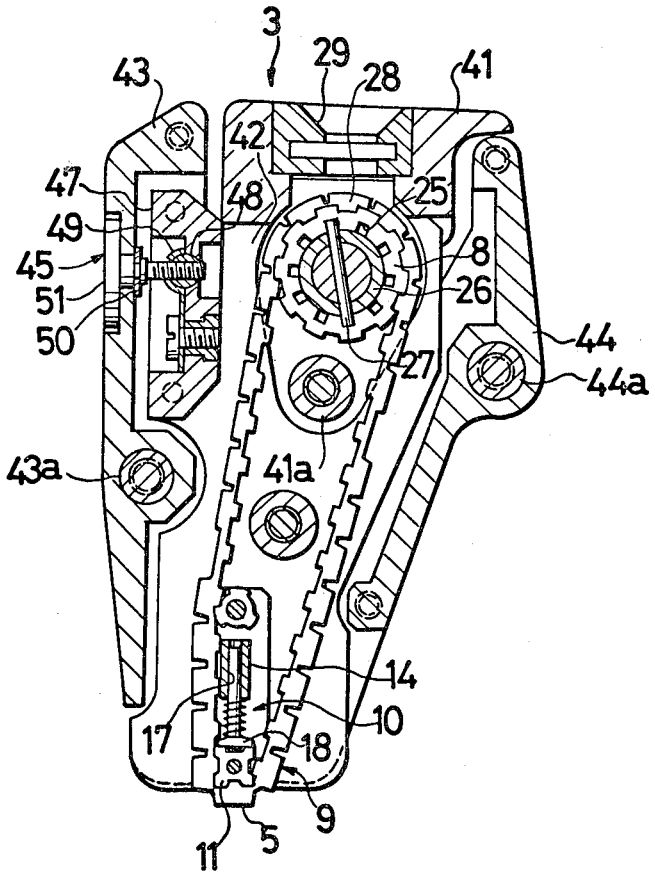
FIG. 3 is a partially cross-sectional, side elevational view of the device of FIG. 2.

With reference to FIGS. 2 and 3, the printing head 3 is now discussed. A selecting knob 7 is engageable with a selected one of a coaxial side by side array of selecting wheels 8. See U.S. Pat. No. 4,018,157, incorporated herein by reference. For each selecting wheel 8, there is a respective one of a plurality of type bands 9 which is moved together with the corresponding wheel 8. The lower ends of the type bands 9, are formed on their exteriors with the printing types. The type band lower ends are held by the positioning members 11 which are under the influence of an elastic support 10. This holds each type band tightly around the selecting wheel 8 and the positioning member 11. As a result, the printing types 5 of the type bands 9 are held in their printing positions while having their surfaces kept at a predetermined angle so as to accomplish the printing operations while their surfaces are to the surface of the label.

Figure 8:
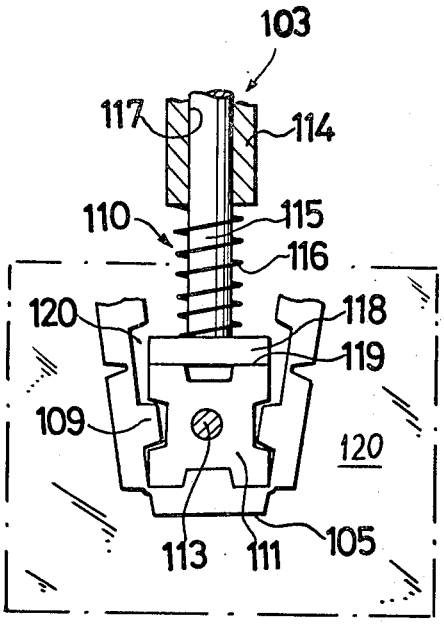
FIG. 8(*a*) is a view similar to that shown in FIG. 4, but showing one known type positioning mechanism.
Figure 8:
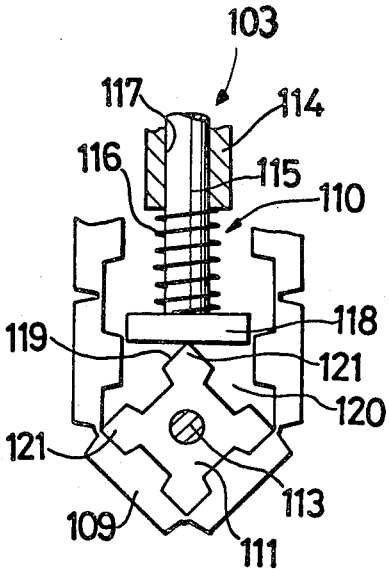
PRIOR ART FIG.8 (b)

Referring to FIGS. 8(*a*) and 8(*b*), prior type positioning mechanisms for the type bands 9 are now explained. These include positioning members 111, which are the same in number as the parallel type bands 109. The positioning members 111 are rotatably mounted on the shaft 113 which is held in a horizontal position in the frames 120 of a printing head 103. An elastic support 110 is positioned above the shaft 113. Support 110 is comprised of a guide block 114, a plurality of pins 115 corresponding in number to the type bands 109, a corresponding number of thrust members 118 and a corresponding number of compression springs 116. The guide block 114 is fixedly supported between the frames 120. It has a plurality of parallel bores 117 extending through it of the same quantity as that of the positioning members 111. The axes of the bores extend toward the printing types 105 then in the printing position. The pins 115 are slidably received in the bores 117 of the guide block 114. Each of the thrust members 118 is integral with the bottom end of the corresponding pin 115. A compression spring 116 is mounted around each pin 115 and is normally charged under compression so that its upper end abuts against the lower surface of the guide block 114 and its lower end abuts against the upper surface of the corresponding thrust member 118.

The lower surfaces of the thrust members 118 are forced by the normal bias of the respective compression springs 116 into contact with the upper side surfaces 119 of the positioning members 111. As a result, the positioning members 111 and accordingly the printing types 105 then at the lowermost ends of the type bands 109 are held in their printing positions while their type surfaces are maintained at a predetermined tilt angle with respect to the surface of a label being printed at all times.

In this known type positioning mechanism, however, since the lower surfaces of the thrust members 118 are made flat, the positioning members 111 often do not fully rotate to a position at which the types are properly oriented. Instead, a positioning member may stop rotating midway between its sides as seen from FIG. 8(*b*), when the selecting knob 7 is turned to move the selected type band 109 and the positioning member 111 for selecting the desired printing type 105. This will result in improper orientation of the respective type 105, with the resultant disadvantage that a desirable clear imprint cannot be obtained. This disadvantage becomes more pronounced when the corner 121 of the positioning member 111 wears and becomes flattened or rounded.

The type positioning mechanism according to the present invention avoids the above described problem. In FIG. 1, the hand labeler is of the type in which the printing device or printing head 3 is mounted in a movable manner. As shown, the hand labeler has its machine frames 36 and 36' extending backward (or to the right in FIG. 1) and they terminate in the integral grip 1. Below the grip 1, there is a hand lever 2, which is swingable about a fixed pivot shaft 35 supported on the machine frames. The hand lever 2 has its forward end forward of pivot shaft 35 formed into the bifurcated yokes 4. The printing head 3 is attached by means of screws 34 between the forward ends of the yokes.

There is a constant printing pressure mechanism, which is comprised mainly of a hook and a coil spring so as to bias the printing head 3 in the downward direction. For further details, see application Ser. No. 787,937, filed Apr. 15, 1977 and incorporated herein by reference. There is a constant pressure mechanism C for the platen 6, which is comprised mainly of an actuating lever and a rotary cam. Also see application Ser. No. 787,937. A return mechanism D, including a return spring supported on the platen 6 and the machine frame 36, returns the platen 6 after printing of a label thereon under a constant pressure by the constant pressure mechanisms B and C. The constructions and operations of the three mechanisms B, C and D have no direct relationship with the type positioning mechanism of the present invention. A label holder 37 removably holds a rolled continuous label strip 40. The continuous label strip unrolls, at 39, from the label holder 37. A feed mechanism 60 feeds or advances the continuous label strip 39 past the platen 6 and printing head 3.

Turning to FIGS. 2 and 3, the printing head 3 includes a printing head casing 41, a pair of side frames 42 fixed to the casing 41 by means of a shaft 41*a*, a front cover 43 and a rear cover 44. There is an angle adjusting assembly 45, which is mounted in the frames 42 and the front cover 43. A pair of side plates 46 are attached to the paired yokes 4 of the hand labeler. The front and rear covers 43 and 44 are fixed to both side plates 46 by means of shafts 43*a* and 44*a*, respectively. A plurality of the type bands 9 are held between the side frames 42. Each type band carries printing types 5 on its exterior. They include imprintable characters, such as numerals, letters or symbols.

The angle adjusting assembly 45 is comprised of an adjustable positionable member 47, a support member 48, a stationary plate 49, a snap 50 and an adjusting screw 51. The angle of inclination of the type surface 105 of the selected type band 9 may be adjusted by turning the adjusting screw 51. For further disclossure as to assembly 45, see application Ser. No. 830,188, filed Sept. 2, 1977, incorporated herein by reference.

The type bands 9 are arranged to all extend parallel to one another and to run around the respective selecting wheels 8, which are supported in the casing 41, and to run around the respective positioning members 11, which are equipped with the elastic support 10 held between the frames 42. Each selecting wheel 8 is annular and has an internal opening surrounded by inwardly facing teeth 25. An engagement member 27 is mounted to a selecting shaft 26, and member 27 is brought into engagement with teeth 25 so as to make it possible to turn the selecting wheel 8 for the desired type band. For turning the engagement member 27, the shaft 26 is equipped with the selecting knob 7.

Each of the type bands 9 is an endless belt. One half carries the selectable relief printing types 5 and the other half carries the respective index characters 28 in a corresponding arrangement to the types 5. The index characters 28 can be observed through an aperture 29 which is formed at the top of the casing 41.

Figure 4:
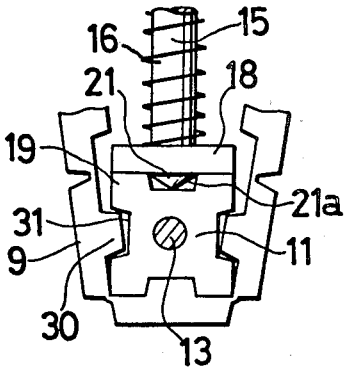
FIG. 4 is an enlarged fragmentary side elevational view of a type positioning mechanism according to one embodiment of the present invention.
Figure 5:
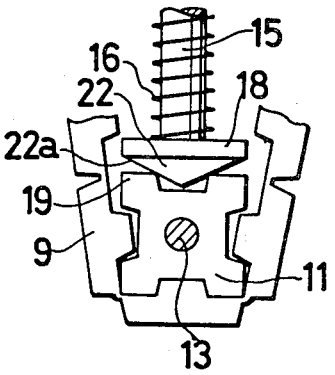
FIG. 5 is a view similar to FIG. 4, but showing another embodiment of the type positioning mechanism.

With reference to FIGS. 3, 4 and 5, the type positioning mechanism, which is located at the bottom of the printing head 3, is described. The positioning members 11 are rotatably mounted in parallel coaxially on a shaft 13 which is held between the frames 42. The positioning members 11 are polygons, preferably square shaped. Each side of each square has a projection receiving formation 31, i.e., an engagement recess, defined in it and this recess is engageable with one of engagement projections 30 that is formed on the inside of the respective type bands 9.

The elastic support 10, which is located above the positioning members 11 as in the above described prior art arrangement, is comprised of a guide block 14, a plurality of pins 15, a corresponding number of thrust members 18 and a corresponding number of compression springs 16. The guide block 14 is fixedly supported between the frames 42 and it has the same number of parallel bores 17 as there are positioning members 11. The pins 15 are received in the bores 17 of the guide block 14 in a manner to slide therein up and down. Each of the thrust members 18 is integral with its corresponding pin 15. Moreover, each of the compression springs 16 is mounted on the corresponding pin 15 and is continuously under compression to have its upper end abutting against the lower surface of the guide block 14 and its lower end abutting against the upper surface of the corresponding thrust member 18. This draws the respective type band tightly around the selecting wheel 8 and the positioning member 11.

Figure 6:
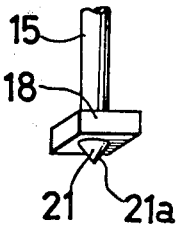
FIG. 6 is a perspective view of a thrust member to be used in the type positioning mechanism of FIG. 4.
Figure 7:
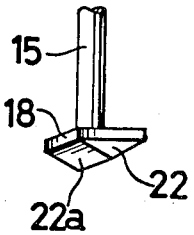
FIG. 7 is a perspective view of a thrust member to be used in the type positioning mechanism of FIG. 5.

As shown in FIGS. 6 and 7, each thrust member 18 has an engagement formation, i.e., a projection 21 or 22, formed at its lower end which is complementary to and, therefore, engageable in the engagement recess 31 of the corresponding positioning member 11. The projections each have a tapering shape, narrowing to the free lower end of the respective thrust member. The projection may be in the shape of a cone 21, as in FIG. 6 or the shape of a wedge 22, as in FIG. 7. The conical or wedge-shaped projection 21 or 22 is sized and positioned to have its inclined surface 21*a* or 22*a* in contact with the corner 19 of the corresponding positioning member 11 when the latter rotates. For the wedge-shaped projection, this requires orienting the wedge so that its tapered sides are directed toward and away from the direction of rotation therepast of the respective positioning member.

It is apparent that the positions of the projections and depressions may be reversed, with the projections being on the positioning members and the depressions being beneath the thrust members. In that case, the profiles of the interiors of the stamp belts would also have to be appropriately altered.

Operation of the type positioning mechanism of the present invention is now described. When a desired type band 9 is selected and turned by the use of the selecting knob 7, then the corresponding positioning member 11 is turned by the engaging relationship between the projection 30 of the type band 9 and the recess 31 of the positioning member 11. Each time an oncoming corner 19 of the positioning member 11 rotates past the projection 21 or 22 beneath a thrust member 18, it rides over and thereby raises the inclined surface 21*a* or 22*a* and the corresponding thrust member 18. This thrust member 18 repeats its up-and-down movements against the action of the corresponding spring 16, while the corresponding pin 15 is sliding in the bore 17 of the guide block 14, until the desired printing type 5 has been brought to its lowermost printing position.

Because the projection 21 or 22 has an inclined surface 21*a* or 22*a*, the corner 19 of the positioning member 11 easily slips on that inclined surface 21*a* or 22*a* with the aid of the biasing force of the compression spring 16. This is quite different from the prior mechanism of FIGS. 8(*a*) and 8(*b*), because the positioning member 11 will not fail to accomplish its complete rotation and will not stop midway thereof. The positioning member 11 can always accomplish its normal rotation to effect the correct positioning of the desired printing type 5. As a result of the above described operations, the printing types 5 of the respective type bands 9 can always be brought into aligned flat positions, thereby making it possible to obtain the desired clear imprints with precise registration.

Furthermore, a click sound is generated and a clear response to each rotation is felt when the corner 19 of the positioning member 11 passes the top of the conical or wedge shaped projection during the rotation of each positioning member 11. Thus, the proper rotation of the positioning member 11 can be clearly confirmed.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A device for orienting the type faces on the stamp belts of a printing device, wherein said printing device is used for a label printing machine, or the like;

said printing device comprising:

a plurality of stamp belts each having an exterior and each carrying a plurality of types arrayed along its exterior;

a respective positioning member for each said stamp belt and around which each said belt passes and which each said belt engages; said positioning member being multisided, and including a first side, which is engageable with a thrust member and which is out of engagement with said belt, and second side pointing in a printing direction and being in engagement with said belt, such that a said type at said positioning member second side will be printed; said stamp belt being drawn securely around said positioning member, thereby to act in opposition to a biasing means; said positioning member being rotatably supported by said printing device and being rotatable such that every side of said positioning member is at one time a said first side and at another time a said second side;

said type face orienting device comprising:

a respective thrust member for each positioning member, each said thrust member having a first complementary formation on a side thereof facing toward said positioning member; said first complementary formation comprising a projection projecting toward said positioning member; each said positioning member first side having a second complementary formation thereon with which said first formation is engageable in a complementary manner; said second complementary formation comprising a depression intermediate the length of the respective said first side of said positioning member and each said positioning member said first side having corner portions beyond both sides of said depression along the length of the respective said first side of said positioning member; the shapes of said first and second formations being complementary such that upon engagement therebetween, said projection is received in said depression; said projection narrows in shape toward the free and thereof, whereby said projection will be slidable into said depression for being held therein and said positioning member is rotated to a position at which its said second side always is aimed in said printing direction;

biasing means for biasing said thrust member first formation against said positioning member second formation;

wherein the thrust member side is of a length to substantially span the length of said positioning member first side; said projection extending from said thrust member side toward and into said positioning member depression, whereby said thrust member side, at both sides of said projection therefrom along the length of that said thrust member side, engages and is biased against the respective said positioning member first side at said corner portions at both sides of the said depression therein, thereby to enhance the stability of the engagement between said thrust member side and said positioning member first side.

2. The device of claim 1, wherein said positioning member first and second sides are on opposite said sides of said positioning member.

3. The device of claim 2, wherein said positioning member is a regular polygon.

4. The device of claim 2, further comprising a respective selector wheel for each said belt and around which each said belt passes and which each said belt engages; said stamp belts being endless belts;

each said endless belt being stretched tight around its respective said selector wheel and said positioning member, thereby to urge said positioning member in opposition to said biasing means.

5. The device of claim 1, wherein said projections are all in the shape of a cone.

6. The device of claim 1, wherein all said projections are in the shape of a wedge, and each said wedge having tapered sides that face toward and away from the direction of relative motion of said positioning member with respect to said thrust member.

7. The device of claim 2, further comprising a guide block having an array of bores defined therethrough; a respective guide pin to which each said thrust member is secured; said guide pins passing through said bores for being guided in their motion thereby, thereby to guide motion of said thrust members as they engage the rotating said positioning members.

8. The device of claim 7, wherein said biasing means includes a respective compression spring mounted on each said thrust member pin and each said spring being interposed under compression between said guide block, on the one hand, and the corresponding said thrust member, on the other hand.

9. A device for orienting the type faces on the stamp belts of a printing device, wherein said printing device is used for a label printing machine, or the like;

said printing device comprising:

a plurality of stamp belts each having an exterior and each carrying a plurality of types arrayed along its exterior;

a respective positioning member for each said stamp belt and around which each said belt passes and which each said belt engages; said positioning member being multisided, and including a first side, which is engageable with a thrust member and which is out of engagement with said belt, and a second pointing in a printing direction and being in engagement with said belt, such that a said type at said positioning member second side will be printed; said stamp belt being drawn securely around said positioning member, thereby to act in opposition to a biasing means; said positioning member being rotatably supported by said printing device and being rotatable such that every side of said positioning member is at one time a said first side and at another time a said second side;

said type face orienting device comprising:

a respective thrust member for each said positioning member, each said thrust member having a first complementary formation on a side thereof facing toward said positioning member, said first complementary formation comprising a projection projecting toward said positioning member; each said positioning member first side having a second complementary formation thereon with which said first formation is engageable in a complementary manner; said second complementary formation comprising a depression intermediate the length of the respective said first side of said positioning member and each said positioning member said first side having corner portions beyond both sides of said depression along the length of the respective said first side of said positioning member; the shapes of said first and second formations being complementary such that upon engagement therebetween, said projection is received in said depression; said projection narrows in shape toward the free end thereof, whereby said projection will be slidable into said depression for being held therein and said positioning member is rotated to a position at which its said second side always is aimed in said printing direction;

biasing means for biasing said thrust member first formation against said positioning member second formation;

wherein said thrust member side is of a length to substantially span the length of said positioning member first side; said projection being of shorter length dimension along the length of said thrust member side than the respective said thrust member side and being located intermediate the length thereof, whereby said thrust member side, at both sides of said projection therefrom along the length of that said thrust member side, engages and is biased against the respective said positioning member first side at said corner portions at both sides of the said depression therein, thereby to enhance the stability of the engagement between said thrust member side and said positioning member first side.

10. The device of claim 9, wherein said projection is in the shape of a cone having its widest diameter less than the length of the respective said thrust member side.

11. The device of claim 9, wherein said positioning member first and second sides are on opposite said sides of said positioniong member.

12. The device of claim 11, wherein said positioning member is a regular polygon.

13. The device of claim 12, further comprising a guide block having an array of bores defined therethrough; a respective guide pin to which each said thrust member is secured; said guide pins passing through said bores for being guided in their motion thereby, thereby to guide motion of said thrust members as they engage a respective rotating said positioning member;

said biasing means including a respective compression spring mounted on each said thrust member pin and each said spring being interposed under compression between said guide block, on the one hand, and the corresponding said thrust member, on the other hand.

* * * * *